US012487046B2

(12) United States Patent
Gidikov

(10) Patent No.: US 12,487,046 B2
(45) Date of Patent: Dec. 2, 2025

(54) SUPPRESSOR

(71) Applicant: BAMEKS-98 AD, Karlovo (BG)

(72) Inventor: Trifon Ganchev Gidikov, Karlovo (BG)

( * ) Notice: Subject to any disclaimer, the term of this patent is extended or adjusted under 35 U.S.C. 154(b) by 0 days.

(21) Appl. No.: 18/572,803

(22) PCT Filed: Sep. 13, 2021

(86) PCT No.: PCT/BG2021/000023
§ 371 (c)(1),
(2) Date: Dec. 21, 2023

(87) PCT Pub. No.: WO2022/266726
PCT Pub. Date: Dec. 29, 2022

(65) Prior Publication Data

US 2024/0288241 A1 Aug. 29, 2024

(30) Foreign Application Priority Data

Jun. 25, 2021 (BG) ..... 5330

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/325; F41A 21/34; F41A 21/36; F41A 21/38
See application file for complete search history.

(56) References Cited

U.S. PATENT DOCUMENTS

| | | | | |
|---|---|---|---|---|
| 7,073,426 | B1 * | 7/2006 | White | F41A 21/30 89/14.4 |
| 2017/0102201 | A1 * | 4/2017 | Bush | F41A 21/30 |
| 2020/0072571 | A1 * | 3/2020 | Washburn, III | B22F 7/004 |
| 2021/0071978 | A1 * | 3/2021 | Washburn, III | F41A 21/30 |
| 2023/0175802 | A1 * | 6/2023 | Bundy | F41A 21/325 89/14.4 |

FOREIGN PATENT DOCUMENTS

DE 202019106316 U1 * 1/2020

* cited by examiner

*Primary Examiner* — Jonathan C Weber
(74) *Attorney, Agent, or Firm* — Patshegen IP; Moshe Pinchas

(57) ABSTRACT

A suppressor comprising a cylindrical housing (1) and a core (2) with radially located disk partitions (3) arranged along it, wherein the thickness of the disk partitions (3) decreases in the direction from the rear to the front of the suppressor, a number of gas openings (4) are provided along the core, a sound-absorbing material is placed in working chambers between two adjacent disk partitions (3), and clamping grooves (6)—offset from each other—are provided in the core (2) yielding a torque to the core when gas escapes therethrough, the sound-absorbing material being a cooling mesh (7) formed in a structured package (8) with an annular shape, consisting of two folded accordion-like strips, one of said strips being folded radially and the other being folded axially in relation to the axis of the compressor.

7 Claims, 4 Drawing Sheets

SUPPRESSOR

FIELD OF THE INVENTION

The invention is related to a rifled firearm suppressor, a.k.a. a silencer, to be mounted in the front section of the rifled firearm barrel and intended to reduce the harmful effects of the gases upon having the bullet exiting/leaving from the muzzle section, thus achieving reduction of noise and recoil when firing.

BACKGROUND OF THE INVENTION

It is well known to anyone, even to a non-specialist in the field of firearms, that when even a single shot is fired, it produces much noise and recoil. These effects (noise and recoil) are caused by the high-pressure gases coming out of the gun barrel immediately after the bullet. Usually, when the firearm is triggered, burning of gunpowder charges in a metal casing delivers a compressive force that accelerates the movement of the bullet through the barrel. The active kinetic energy causes the bullet to move towards the target.

Release of gases from the charge burning is accompanied by a high level of noise and recoil. The magnitude of this noise is usually proportional to the speed and pressure of the gases. Regardless of the caliber of firearms, when used, they emit harmful noise levels when fired, resulting in permanent damage of hearing and the central nervous system.

In order to reduce noise and recoil at firing, it is necessary to reduce the pressure and speed of the gases exiting the firearm barrel after the bullet. Using the well-known relation pressure÷volume, it is common to look for constructive solutions where high-pressure gas is expanded into a closed-volume casing, having one end fixed to the barrel of the firearm and the other end of the body is actually the suppressor part of the device where expansion is provided in a controlled manner, thereby simultaneously reducing the pressure level and the speed of the gases.

A wide variety of design/construction solutions is known in practical embodiments, aiming to slow down the speed of the gases at firing.

These devices are designed to be mounted on the barrel of the firearm, boasting a high degree of strength. Most of these devices usually consist of a housing where, by using different in shape and layout elements (barriers, openings and channels) the fired gases from the gunpowder charge are directed and pass through these elements.

The analysis of known patented technical solutions shows that, for the purpose of reducing the pressure of the gases, suitable combinations of structural elements such as internal partitions, channels, openings, and gratings are used to form interconnected work chambers (working volumes).

Studies of the known suppressors in the market show these structural elements have the effect of not only reducing the pressure, but also simultaneously reducing the temperature of the gases released at firing, thus achieving a favorable control of the flow of gases, i. e. it may be possible to create conditions to allow the release of the separated gases to be performed for a longer period of time through the axial orifice of the bullet passing.

A suppressor is known produced by Recknagel (Product catalog—March 2019), and it consists of a cylindrical metal housing, and its interior space houses a core with a disk-shaped partition system of elements and openings made along the outer surface on the core. When the bullet enters the casing of the suppressor, the disk partition system acts so that after passing through each subsequent partition, the gas pressure begins to decrease, thus creating conditions of controlling the speed of the gases after the bullet.

A suppressor is known, as described in PM Reg. № 3438, consisting of a housing where a core with radially arranged partitions is located in, the thickness of which decreases in the direction from the rear to the front end of the suppressor; and gas openings are made in the core. At least one fixing orifice is made in the rear part of the core, in particular before the section with the gas openings, while a replaceable sleeve with an internal thread corresponding to the thread of the respective barrel is mounted inside the core. On its outer surface, two threaded sectors are formed, separated by a channel, where the sleeve is placed in the core so that the channel of the sleeve coincides with the fixing orifices, where the fixing elements are screwed to the stop. In the back part of the core, a widening is formed in the inner diameter of which a channel is further formed, with a slotted ring located in it.

Patent Publication EP1255959 B1 is known, and it describes a suppressor mounted on the barrel of the firearm by means of a threaded connection internally formed on the core of the suppressor. The device consists of an external casing where the core is located in, and radially shaped disk elements on it forming the working chambers. The core and disk elements are formed as a single body, with gas openings arranged radially along the core, located in the working chambers in front of the muzzle cut. The chambers are defined [formed] by an outer sleeve and an inner sleeve extending longitudinally in the silencer, and a number of disc-shaped surfaces extending between the outer and inner sleeves. The disc surfaces are suitably shaped for this purpose—as integral parts of the inner sleeve. According to the present invention, the silencer is preferably made of aluminum; other suitable material such as titanium, alloy, synthetic material and the like can be used for its production, too.

The efficiency of the silencer can be enhanced by filling all or some of the chambers—fully or partially—using a muffler material, such as aluminum chips. By using such filling with sound-insulating material, the outer periphery of the inner sleeve between the disc surfaces must be covered with a fine mesh, e.g. stainless steel so that the soundproofing material cannot enter the orifice through the openings of the inner sleeve. Depending on the firearm, the silencer should to be further adapted to the length of each chamber; the number of orifices for capturing the emitted gas and the distance between the inner and outer bushings can be additionally changed.

When firing, the released gases pass through the said gas openings formed along the core, whereby a portion of the released gases return back through the openings formed on/along the disk elements, entering the suppressor chambers, located between two disk elements behind the muzzle cut, then return to the front section and exit the suppressor through its central opening.

During the use and operation of the suppressor described above, dynamic forces arise from the gases released during the shot, in their presence the product is subjected to vibrations, and as a result of it, there is a loosening of the threaded connection between the suppressor and the barrel of the weapon further reflecting on breaking the co-axis between the barrel opening and the suppressor opening.

Another disadvantage of the known suppressor is the filling of the chambers with sound-absorbing material—in this case with aluminum chips. We believe the shape of the chips and its free placement within the volume of the chamber do not provide a sufficiently effective way in reducing the level of control over the speed and temperature of gases, as long as the shape of the chips does not allow controlled filling of each chamber—in order for it to ensure the required effective ratio: chamber volume÷cooling area and weight.

SUMMARY OF THE INVENTION

Taking into consideration the aforesaid known level of the technology in the revised field, the scope of the invention is to offer a suppressor able to provide a significant reduction of noise and recoil by the fired/released gases, allowing high firing rate while maintaining efficiency as well as achieve longer durability on the use of the silencer between the accepted standard inspection and technical maintenance periods.

The scope of the invention is solved by a suppressor consisting of a cylindrical casing, where a core with radially disposed disk elements is arranged in; its thickness decreases in the direction from the rear to the front end of the suppressor, having a number of gas openings made along the core, where the openings in a row are shifted in relation to the openings in another row, while the working chambers formed between two disk partitions are filled with sound-absorbing material.

According to the invention, at least two shifted one towards another clamping grooves are made in the core, while the sound-absorbing material in the space between the disk partitions is a cooling mesh, with the size of the openings from 0.02-2.00 mm and it is formed in a structured package of an annular shape consisting of two folded accordion-like strips of cooling mesh intersecting in different planes at an angle of less than 30°, the folds of one being radially and of the other being axially arranged with respect to the axis of the chamber. The filling of the volume of each chamber of the structured package has been determined at a ratio of: volume, 1 $mm^3$:cooled area, 1 $mm^2$—from 1:1 to 1:1.4.

According to a preferred embodiment of the invention, the clamping grooves are three and are arranged symmetrically along the core, the grooves being arranged at an angle to the axis of 10-45 degrees.

According to a preferred embodiment, each chamber is filled with a cooling mesh. According to another preferred embodiment, only the first three chambers (rear to front) are filled with cooling mesh.

According to another embodiment of the suppressor, the first three working chambers are filled with a cooling mesh with openings of 0.20-0.55, while the subsequent working chambers are filled with a cooling mesh with openings of 0.55-1.00 mm.

In a preferred embodiment of the suppressor, a structured package made of a corrugated/folded strip of cooling mesh with a folded triangular shape arranged in a plane is housed within the volume of each chamber.

In a preferred embodiment of the suppressor, the cooling mesh is made in a folded triangular shape.

According to a preferred embodiment of the suppressor, the filling of the volume of the chambers is carried out in compliance with the ratio of chamber volume:mesh area—1 $mm^3$:1.4 $mm^2$.

Preferably, the cooling mesh is made of a material such as chromium-nickel steel, titanium or other material, providing high thermal conductivity, heat resistance, passive to chemically aggressive environment/-s.

According to a variant embodiment of the suppressor, a strip-like element of a mesh with a width equal to the distance between two adjacent baffles/partitions is placed above the cooling mesh in the section of the chamber.

According to the invention, the suppressor features a technically and technologically efficient design. Structurally, the cylindrical core is designed so that when gases leave through the clamping grooves, a torque is created acting on the housing of the separator, the size of which is determined by the angle of the clamping grooves to (towards) the axis as well as by the dimensions and area of the walls of the clamping grooves. The torque has a direction of rotation equal to the direction of tightening/clamping, as a result of which the suppressor is secured against self-unwinding or loosening of the connection of the two elements—the suppressor and the barrel of the weapon.

The improved efficiency of the silencer is mainly expressed in the controlled filling of the chambers with a cooling mesh, as the laying of the folded cooling mesh with a pre-defined shape ensures the effective extension of the path of the gases forced to pass through a huge number of cells formed by the cooling mesh located in the chambers designed between two disk partitions. As it can be seen from the exemplary embodiments, the mesh may be housed in the chambers using a different form of its folding. In some embodiments of the invention, an additional strip of cooling mesh is used, and it covers the chamber at the peripheral surface, compressing and limiting the cooling mesh located in the chambers.

DESCRIPTION OF THE DRAWINGS

According to the invention, an exemplary embodiment of the suppressor is presented in more details using the accompanying drawings, where.

PRIMARY EMBODIMENT OF THE INVENTION

Figure 1:
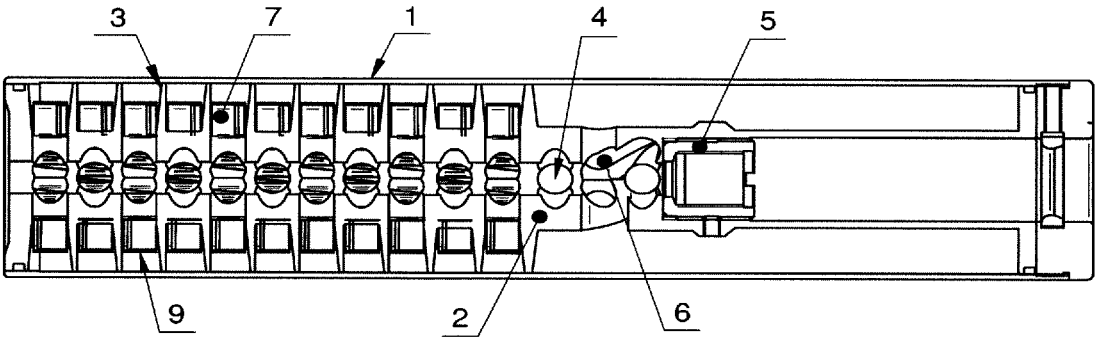
FIG. 1 A view of the core according to the utility model
Figure 2:
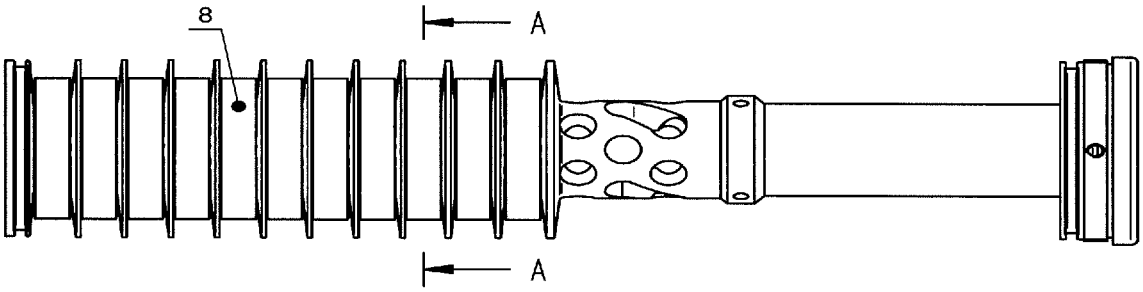
FIG. 2 A core with cooling mesh laid between the disk partitions, according to the utility model FIG. 3 A cross-sectional view of the AA from FIG. 2
Figure 3:
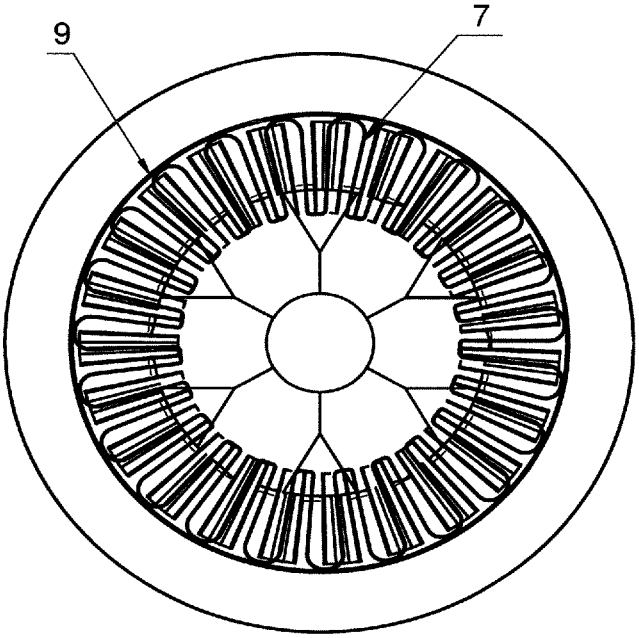
Figure 4:
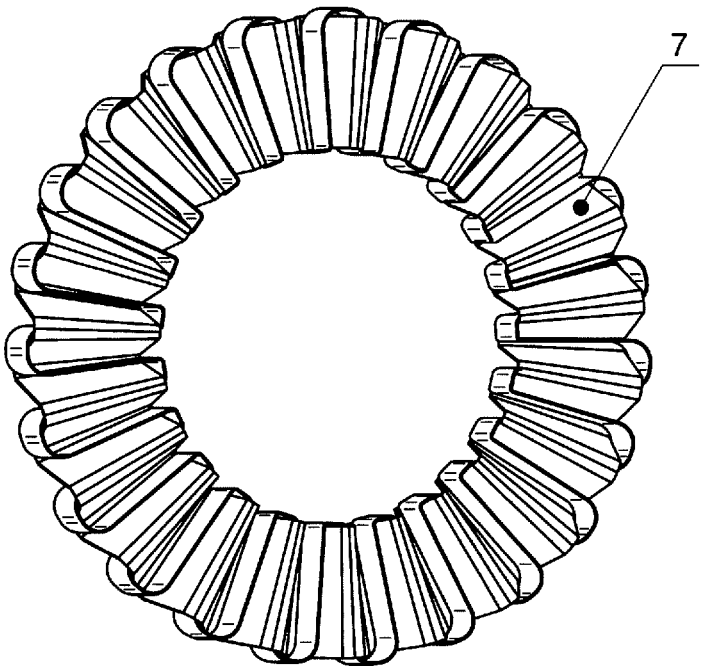
FIG. 4 A front view of the cooling mesh with a structured package of two sheets of mesh, folded accordion-like FIG. 5 An axonometric view of a structure package of the folded cooling mesh and the covering strip FIG. 6 A front view of the cooling mesh with a structure package of one mesh—a triangular shape FIG. 7 A $2^{nd}$ axonometric view of a structure package of the folded cooling mesh and the covering strip.
Figure 5:
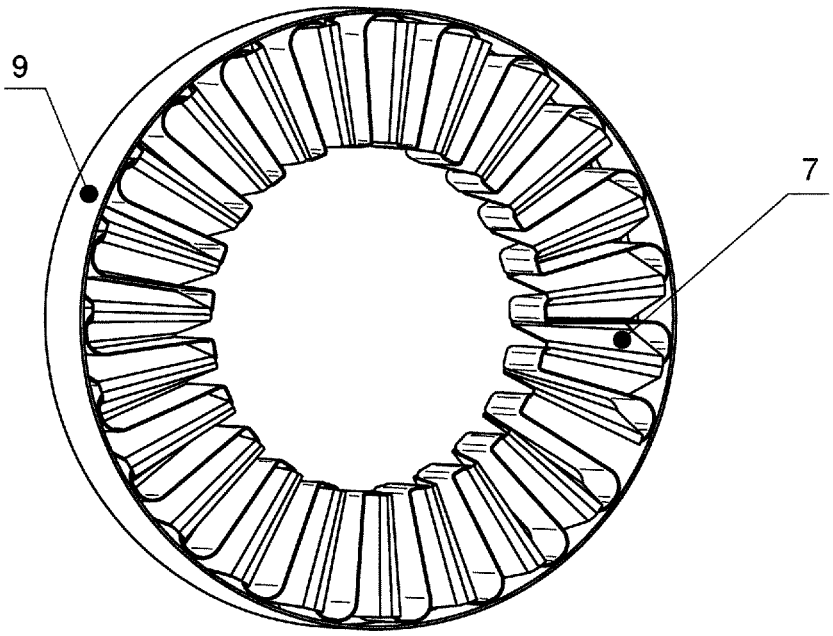
Figure 6:
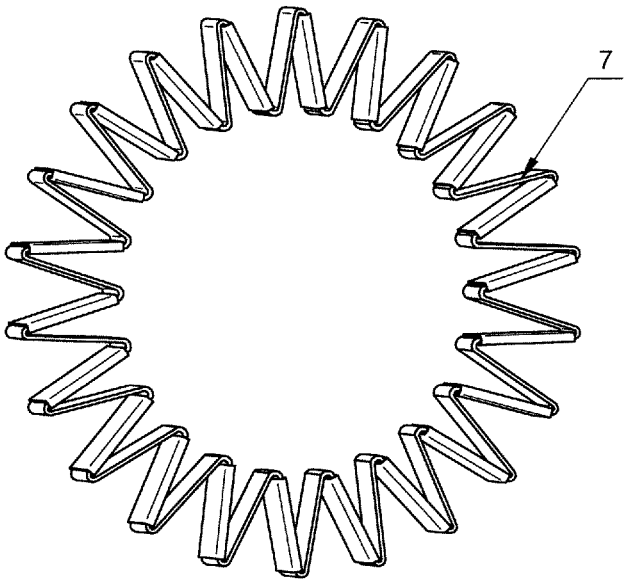
Figure 7:
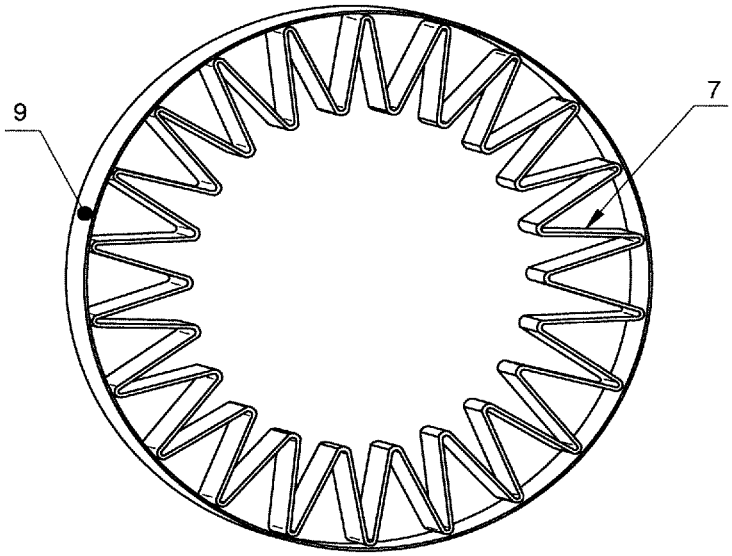

The description further provides an exemplary embodiment of a suppressor according to the invention, characterized by a technological construction providing improved noise reduction functionalities when using a firearm, and an exemplary embodiment is provided suitable for use with hunting weapons and it does not restrict their use in other firearms, as well as the use of barriers and openings adapted in regards to their placement and design, in a way that provides an equivalent effect in suppressing noise accompanying the movement of gases when discharged from the barrel of a firearm.

The present invention can be understood in more details by reference to the accompanying drawings, description, examples and claims. The above should not be construed as limiting to the exemplary embodiment described, with its specific constructive elements, insofar as variations of the embodiment can be made.

According to the invention, the suppressor consists of a cylindrical casing 1; a core 2 is located inside it; and partitions 3 and gas openings 4 are placed along the core; the partitions and openings form interconnected working chambers in the housing. Inside the core 2 a replaceable connecting sleeve 5 with an internal thread is placed; the thread corresponds to the thread of the respective barrel.

At least two clamping grooves 6 are arranged on the body of the core 2, oriented relative to each other, so that when gases pass through them, a torque is created ensuring self-tightening of the suppressor to the barrel, thus a guaranteed connection between the barrel and the suppressor is ensured.

In the working chambers formed in the space between two disk partitions 3 a cooling mesh 7 is placed, sized: 0.35 mm of the openings; and the filling of the volume of the working chambers is ensured in compliance with the ratio "volume of the chamber:area of the mesh"—it is 1 $mm^3$:1.4 $mm^2$.

Preferably, the cooling mesh accommodated in the working chambers is formed in a structured ring-shaped package 8 composed of two folded accordion-type strips, when folded the two strips of mesh intersect in different planes located below an angle of less than 30°, the folds of one being arranged radially and the other one being arranged axially relative to the chamber, as a result of which the folded strips form a number of small hollows (chambers) with a pyramidal shape.

The height of the structural package with the folded cooling mesh 7 is determined by the distance between the outer surface of the core 2 and the periphery of the disk partitions 3 and is placed so as to fill the space to the periphery of the disk partitions 3, where a strip element 9, is placed above the cooling mesh 7—the element is made of mesh with the size of the openings of 0.75 mm, and with a width sufficient to cover the radiator thus formed.

According to another variant embodiment of the suppressor, the structural package 8.1 is made of a folded strip of accordion-type mesh, with a triangular shape, the strip being arranged in one plane, whereby the volume of each chamber is filled in a controllable manner, forming a number of cells in each chamber, thus determining—in a controlled manner—the area the gases must pass through for the purpose of cooling them before leaving the suppressor.

The description is to be understood as follows: the terminology used herein is for the purpose of describing specific aspects only and cannot be restrictive in this regard. The described exemplary embodiment represents a preferred embodiment, not limiting the possibilities for carrying out other variant embodiments, ensuring the achievement of a comparable technical effect.

Specialists in the reviewed technical field will recognize and welcome the fact various design changes may be made, similar to the described ones herein, while still obtaining favorable results with respect to the level of noise reduction produced by the gases released by the explosive substance after firing a shot.

When fired, the released gases enter the suppressor, whereby part of them, passing through the clamping grooves 6, create torque and act on the core, whereby they rotate it and thus counteract the forces of unwinding, further achieving self-tightening, ensuring a secure connection between the suppressor and the barrel of the weapon. The gases released during the shot pass in front of the gas openings 4 in the core 2 and enter the chambers through them, where they pass through the structured package of the cooling mesh 7, the parameters of which are predetermined so as to provide the necessary path of the cooled gases until their acceptable cooling is reached.

The invention claimed is:

1. A suppressor comprising:

a cylindrical housing;

a core of radially located disk partitions arranged along said cylindrical housing; the thickness of these decreases in the direction from the rear to the front of the suppressor;

a number of gas openings are made along the core, one row is offset from the openings of another row the partitions and the gas openings form interconnected working chambers;

a sound-absorbing material is placed in the working chambers between two adjacent disk partitions;

at least two, clamping grooves—offset from each other—are placed in the core;

wherein the sound-absorbing material in the space between the disk partitions is a cooling mesh, with the size of the openings from 0.02-2.00 mm and wherein said cooling mesh is formed in a structured package with an annular shape, a ratio of working chamber mesh volume $mm^3$ to mesh cooling area $mm^2$, defined by the surface area of the mesh material, is 1:1 to 1:1.4.

2. The suppressor according to claim 1 wherein the clamping grooves are three and are arranged symmetrically along the core.

3. The suppressor according to claim 1 wherein each one of the working chambers is defined between two adjacent disk partitions.

4. The suppressor according to claim 1 a structured package is arranged in the volume of each chamber, wherein said cooling mesh includes a corrugated strip of cooling mesh, with a folded triangular shape arranged in one plane.

5. The suppressor according to claim 1 further comprising a strip of mesh element with openings, said mesh element is placed over the cooling mesh.

6. The suppressor according to claim 1 wherein the cooling mesh is made of chromium-nickel steel, or titanium.

7. The suppressor according to claim 1 wherein said cooling mesh includes two strips folded in an accordion-like form, one of the two strips is folded radially with respect to the axis of the chamber and the other one of the two strips is folded axially with respect to the axis of the chamber, the two strips intertwined with one another such that planes of one of the two strips intersect with planes of the other one of the two strips at an angle of less than 30°.

* * * * *